US007819256B2

(12) United States Patent
Lindner

(10) Patent No.: US 7,819,256 B2
(45) Date of Patent: Oct. 26, 2010

(54) HEAVY MATERIAL SEPARATOR

(76) Inventor: Manuel Lindner, Villacher Strasse 48, Spittal/Drau (AT) A-9800

( * ) Notice: Subject to any disclaimer, the term of this patent is extended or adjusted under 35 U.S.C. 154(b) by 78 days.

(21) Appl. No.: 11/912,564

(22) PCT Filed: Apr. 26, 2006

(86) PCT No.: PCT/EP2006/003877

§ 371 (c)(1),
(2), (4) Date: Jun. 24, 2008

(87) PCT Pub. No.: WO2006/114302

PCT Pub. Date: Nov. 2, 2006

(65) Prior Publication Data

US 2008/0290001 A1 Nov. 27, 2008

(30) Foreign Application Priority Data

Apr. 26, 2005 (EP) ..... 05009117

(51) Int. Cl.
*B07C 1/00* (2006.01)

(52) U.S. Cl. ..... 209/656; 209/657; 209/658

(58) Field of Classification Search ..... 209/656, 209/657, 658

See application file for complete search history.

(56) References Cited

U.S. PATENT DOCUMENTS 1,184,616 A * 5/1916 Bonella ..... 431/223
3,334,739 A 8/1967 Jarvis
5,205,418 A 4/1993 Toschi
5,641,055 A * 6/1997 Anderson ..... 198/631.1
5,938,373 A * 8/1999 Scudder ..... 405/179

FOREIGN PATENT DOCUMENTS

| | | | |
|---|---|---|---|
| DE | 8715942 U1 | | 1/1988 |
| DE | 4031584 A1 | | 4/1992 |
| DE | 29606223 U1 | | 7/1996 |
| DE | 20217037 | * | 5/2000 |
| DE | 20217037 U1 | | 4/2003 |
| EP | 0482566 A | | 4/1992 |
| GB | 1184616 A | | 3/1970 |
| GB | 2193449 A | | 2/1988 |
| WO | 0238291 A | | 5/2002 |
| WO | WO 0238291 A1 | * | 5/2002 |

* cited by examiner

*Primary Examiner*—Gene Crawford
*Assistant Examiner*—Terrell H Matthews
(74) *Attorney, Agent, or Firm*—IP Strategies

(57) ABSTRACT

The present invention refers to a separator for separating heavy material components, particularly stones, ceramic material and glass, from a flow of solid material comprising heavy and light material components, comprising a first conveying means for conveying the flow of solid material, a second conveying means provided for conveying the non-separated material components of the flow of solid material downstream of the first conveying means, a flexible means arranged between the downstream end of the first conveying means and the upstream end of the second conveying means and which is formed such that the light material components are conveying from the first conveying means past the flexible means to the second conveying means and the heavy material components leave the flow of solid material in front of the upstream end of the second conveying means (5). The invention further refers to a method of separating heavy material components by means of a flexible means.

14 Claims, 3 Drawing Sheets

HEAVY MATERIAL SEPARATOR

FIELD OF THE INVENTION

The present invention refers to a device for separating components of a high specific density from a flow of material of a solid matter mixture composed of heavy and light material components. The invention particularly refers to the separation of heavy materials of a shredded flow of material of waste products in a recycling apparatus.

BACKGROUND OF THE INVENTION

The object of separating different materials which constitute a conveyed flow of material, arises in various applications, such as in the purification of wood material and particularly in the separation of heavy materials from shredded commercial waste, industrial waste, domestic waste etc.

Magnetic separators can be used for iron-containing metal materials, which, however, are useless for sorting non-metallic heavy materials, such as stones, ceramic material or glass.

So-called air separators for classifying and sorting the components of a flow of material are very popular. In these machines the flow of material is conveyed into an inspection chamber and is exposed to a conveying air flow. The flow of material is for instance (see German laying-open specification DE 199 45 646 A1) conducted into a drum by means of a transport device and while the drum rotates, a flow of air guided through the drum conducts material components of a low specific density in the direction towards a drum outlet arranged on a higher level, which is possibly connected to a vacuum chamber, to discharge the material components, while heavier material components are merely entrained by the drum to be discharged at a drum outlet arranged on a lower level. At the transition from the upper drum outlet to the outlet channel, a controllable air barrier can also be provided to further improve the sorting process.

In other embodiments of air separators, lighter materials can be transported via an air bridge between two transport devices, said air bridge being generated by a fan, while heavy materials fall through between the transport devices. Such a pure air separation particularly involves the disadvantage of the required frequent adjustment of the air flow depending on the material composition. The required air quantity is very high and the separation accuracy is significantly restricted, as is the case in the above-mentioned method.

A combination of the air bridge alternative with a mechanical intermediate conveyance through a roller rotating in the general conveying direction, to which light substances are conveyed by an upstream transport device by means of a fan acting from below, whereas heavy materials shall fall into the gap between this transport device and the roller, also has the disadvantage of a higher quantity of air required. Thus, these embodiments are particularly susceptible to moisture. Furthermore, adhesive heavy materials reaching the drum are disadvantageously conveyed through the drum to the downstream transport device.

Besides pure or combined air separators, purely mechanical sorting apparatus also exist. The flow of material is for instance introduced through a transport device from the top into the contact area between two brush rollers rotating in opposite direction towards the outside. Lighter materials shall follow the rotary movement of the roller, whereas heavy materials shall be conducted through the contact area between the rollers. Besides the problem of winding up thin expanded materials, it is unavoidable in such a design that along with the heavy materials that are sorted out by the brush bristles in the contact area, light, particularly relatively small light material components, disappear from the flow of material.

Thus, it is the object of the present invention to provide an improved heavy material separator and to provide a method of separating heavy materials from an inhomogeneous flow of material whose reliability in the prior art is not affected or only to a small extent by the above-mentioned problems.

BRIEF SUMMARY OF THE INVENTION

The above-mentioned object is solved by a separator according to claim 1 for separating heavy material components, particularly stones, ceramic material and glass, of an inhomogeneous flow of solid matter which comprises heavy and light material components, comprising a first conveying means (2) for conveying the flow of solid matter;

a second conveying means (5) provided downstream of the first conveying means (2) for conveying the non-separated material components of the flow of solid matter;

a flexible means (3) arranged between the downstream end of the first conveying means (2) and the upstream end of the second conveying means (5) and which is adapted such that the light material components are transported from the first conveying means (2) via the flexible means (3) to the second conveying means (5) and the heavy material components leave the flow of solid material in front of the upstream end of the second conveying means (5).

The flow of solid material may comprise stones, chunks of rock, steel spheres as heavy components and is conveyed to the means coming from the upstream side.

The first and the second conveying means can be inclined at different angles with respect to the base. The ends facing the flexible means may be arranged on the same level. The end of the first upstream conveying means facing the flexible means is preferably positioned higher than that of the second downstream conveying means.

The flexible means has a reset force which counteracts the weight of the material components. Light material components deform the flexible means to an insignificant extent only. Heavy material components can deform the flexible means in a way that they leave the flow of solid material in front of the upstream end of the second conveying means. They can particularly be separated downwards from the flow of solid material into the resulting gap between the two conveying means.

Thus, a separation of the heavy material components from the flow of solid material with a satisfactory separation accuracy and high reliability with respect to the sorting out of heavy material components is enabled.

According to a preferred embodiment, the flexible means can at least partially be pervious to gas and at least partially pervious to the heavy material components for separating the heavy material components. In principle, the heavy material components can also be separated only downstream by the flexible means or only through this flexible means.

The above-mentioned means can for instance comprise a brush means or a lamella means. The expression "brush means" is to be understood in a very general way. The bristles can both be flexible and rigid, e.g. in the form of metal pins, such as Nirosta metal pins. The bristles can be positioned fixedly or they may be adjustable so that the gaps between the bristles can be varied. All bristles can have the same spacing to one another or different bristle gaps can be chosen along the brush.

The brushes can be aligned at different angles with respect to the horizontal. They can preferably have an angle of less than 45° with respect to the horizontal.

In the case of a brush means, gaps exist between the bristles or bristle groups of the brush means, e.g. of a modified conventional strip brush, as it is also used for cleaning transport belts. The bristles accept the heavy material components and let them pass between them towards the bottom of the flexible means where they are collected by a reservoir. Such a brush means can be realized in a relatively simple manner as a relatively robust flexible means.

An alternative embodiment of the flexible means has a lamella structure. The gaps between flexible lamella elements form the passages for the heavy material components. An inclined position of the lamellae and a respective angle can preferably be predefined and/or dynamically adapt to the heavy material components and/or be controlled continuously during operation. The longitudinal direction of the lamellae can be oriented substantially in parallel to the material flow direction i.e. the conveying direction, or at a certain angle thereto. The lamellae can consist of plastic material, e.g. polyamide, or of metal sheet, e.g. aluminum sheet, Nirosta sheet. The position of the individual lamellae can be fixedly determined or adjustable, and different gaps can be selected between the lamellae.

The separator can preferably have an additional gas supply means for supplying gas in a manner that the flexible means is supported against a bending caused by the weight of the light and heavy material components. The gas supplied can be air of the temperature and density of the ambient air.

Thus, the flexible means can be stabilized by the gas flow against the material components resting thereon. The gas flow can be controlled to achieve a specific sorting with a favorable separation accuracy for a predetermined composition of the flow of solid material in combination with the predetermined reset force of the flexible device. The gas supply means can particularly supply air in a controllable manner according to the weight of the heavy and/or light material components.

The gas supply can be implemented partially by the flexible means and partially at the (material) downstream side past the flexible means.

The velocity of the gas supplied, preferably air, above the flexible means is reduced compared to the velocity underneath the flexible means. The gas blown through the flexible means forms an air cushion above the flexible means which can carry the light components of the flow of solid material. They drift on the cushion downstream and leave the flexible means at the downstream end, which can for instance exclusively be held by the gas flow. The light components are further conveyed via the gas flow passing by the downstream end of the flexible means.

The heavy components first of all remain on the flexible means, since they are too heavy to lift off the air cushion from the surface of the flexible means, to at least partially fall through same after a short period of time. A certain part of the heavy material components can also be separated from the flow of solid material behind the downstream end of the flexible means and in front of the downstream conveying means.

By the inventive combination of mechanical and gas-dynamic sorting, a very efficient separation of heavy and light solid matter material components is achieved. The separation accuracy is higher compared to the prior art and the air quantity required is lower compared to conventional air separators. The gas quantity and gas velocity can be optimized e.g. in combination with the flexibility of the flexible means and depending on the composition of the flow of solid material to be sorted.

The flexible means can comprise at least two flexible elements on its downstream end, said elements being formed such that convey independent of one another the light material components from the first conveying means to the second conveying means, and the heavy material components leave the flow of solid material in front of the upstream end of the second conveying means (5) and are therefore separated.

The flexible elements can be attached at the downstream end or the downstream end can end on these elements, i.e. they are formed by respective cuts along the longitudinal direction (material flow direction) of the flexible means. Some of the elements can bend caused by the load of the heavy material components, whereas other light material components further convey to the second downstream conveying means.

The flexible elements can be steel sheets, such as Nirosta steel sheets. They can also be made of plastics, e.g. of polyamide.

In a relatively simple embodiment of the separator according to the invention, the flexible means may be a metal plate with a plurality of openings when a gas supply means (4) for supplying gas is provided partially through openings of the metal plate and partially past the downstream side of the metal plate. In this case, the flexibility of the flexible means used is very low or even infinitesimal.

Heavy material components, which are conveyed by the upstream conveying means, impinge upon the metal plate, e.g. a Nirosta plate, and impinge downstream where they are separated from the flow of solid material through a gap formed between the downstream end of the metal plate and the upstream end of the downstream conveying means. The light material components are transported through the gas passed by the metal plate over the gap.

Thus, a simple efficient separation of heavy material components from the flow of solid material is possible, if it can be avoided that material components block the openings of the metal plate.

The above embodiment of the flexible means can be connected with the first conveying means or the second conveying means or with both. Preferably it can be connected to the first (the upstream) conveying means. The downstream end of the flexible means can for instance be held only by the air flow.

The separator can have a third conveying means which is connected upstream with the second conveying means and which accepts the light, non-separated components of the flow of solid material from the flexible means or the air flow passing by the downstream end of the flexible means, and which carries the light material components, and transports them to the second conveying means. Such a third conveying means facilitates removal of the light components from the flexible means downstream.

In the above-mentioned examples for the separator, an expansion chamber for the gas can be provided above the flexible means or the metal plate, particularly above the flow of solid material. This expansion chamber can decelerate or collect the flowing gas and possibly return it to the gas supply. For the latter a suction means for sucking off the gas from the expansion chamber and/or a gas return means for returning the gas from the expansion chamber to the gas supply means can be provided.

The invention also provides the use of a separator for separating heavy materials from an inhomogeneous flow of solid material for separating heavy material components from an inhomogeneous flow of solid material.

The above-mentioned object is further solved by a method of separating heavy material components, particularly stones, ceramic material and glass from a flow of solid material, comprising conveying a flow of solid material comprising heavy and light material components to a separation position;

accepting the flow of solid material through a flexible means at the separation position;

supplying a gas to the separation position and partially through the flexible means and/or partially past the downstream side at the flexible means, in a manner that 1) the flexible means is supported, 2) a gas cushion is formed above the flexible means for carrying the light material components, and 3) light material components are transported from the downstream end of the flexible means downstream;

separating the heavy material by the flexible means.

The flexible means can comprise a brush means. The heavy material components are prevented from further being transported by the bristles of the brush means. They rest for a short period of time on the brush means and are then separated by the brush means.

The light material components "float" on the air cushion and are transported at the downstream end of the flexible means through the gas flow passing by the flexible means further downstream. Thus, the method according to the invention enables a sorting with a high separation accuracy.

The gas quantity, gas velocity and gas flow direction can be controlled manually or automatically according to the composition of the flow of solid material.

BRIEF DESCRIPTION OF THE DRAWINGS

Further features and exemplary embodiments of the present invention will be described hereinbelow by means of the drawings. It is self-evident that the embodiments are not exhausted by the field of the present invention. It is also self-evident that some or all features described hereinbelow can also be combined with one another in a different manner.

DETAILED DESCRIPTION OF THE INVENTION

Figure 1:
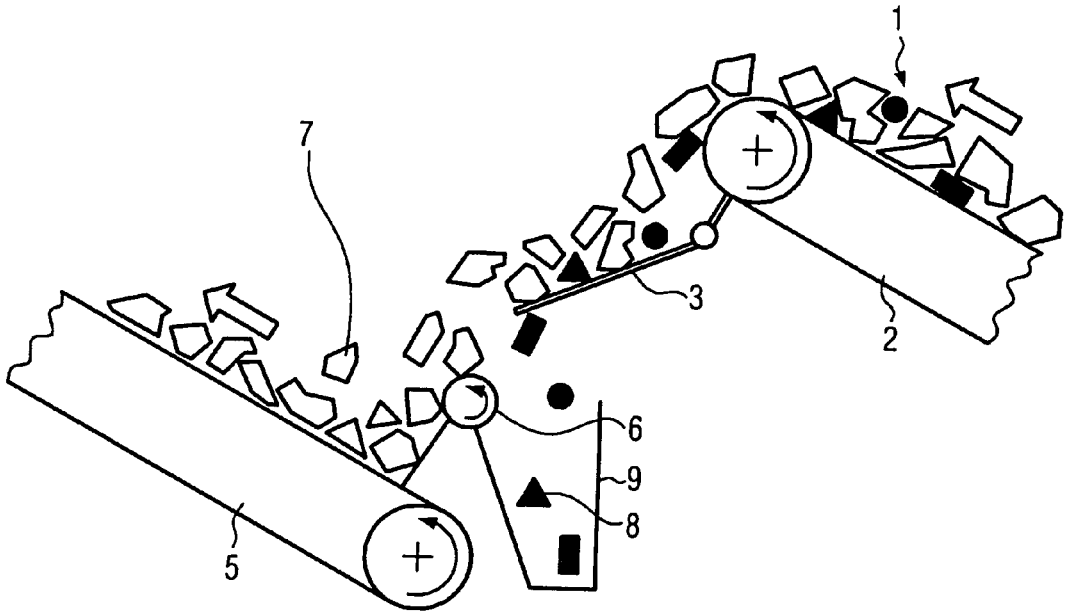
FIG. 1 is an example for a separator according to the present invention, which comprises three transport devices and one flexible means.

As shown in FIG. 1, an inhomogeneous flow of solid material 1, which particularly contains light material components (drawn bright) and heavy material components (drawn dark) is conveyed via a first transport device 2 according to an example for the separator disclosed. The transport device 2 comprises an endless conveying belt which is moved by a driven rotary roller, as it is known in the prior art. The transport device 2 is erected transversely inclined, and a flexible means 3 is connected with the transport device 2 on the upper end in which the flow of solid material is conveyed.

The end of the flexible means 3 is spaced from a second transport device 5, with a upstream end positioned lower with respect to the downstream end of the first transport device 2. The second downstream conveying means 5 conveys the material components which were not separated by the flexible means 3 further downstream.

The flexible means 3 is for instance made of plastics and has a reset force (restoring force) caused by its material. The reset force is counteracted by the weight of the material components of the flow of solid material transported on the means. Light material components can move over the flexible means without remarkably bending the flexible means downward. Heavy material components bend the flexible means 3 in a manner that they fall downwards into the gap between the first transport device 2 and the second transport device 5 and are therefore separated from the flow of solid material that is conveyed over the second transport device 5, and which now substantially consists of the light material components only.

A plurality of flexible elements can be attached at the downstream end of the flexible means 3, said elements bending independent of one another under the weight of the heavy material components. The flexible means 3 can also end downstream in several flexible elements which can bend independent of one another under the weight of the heavy material components.

The heavy separated material components 8 are received by a suitable reservoir 9. For a better handover of the light material components to the second transport device 5 to the further upstream conveyance of the light material components an auxiliary transport device 6 is optionally provided.

Figure 2:
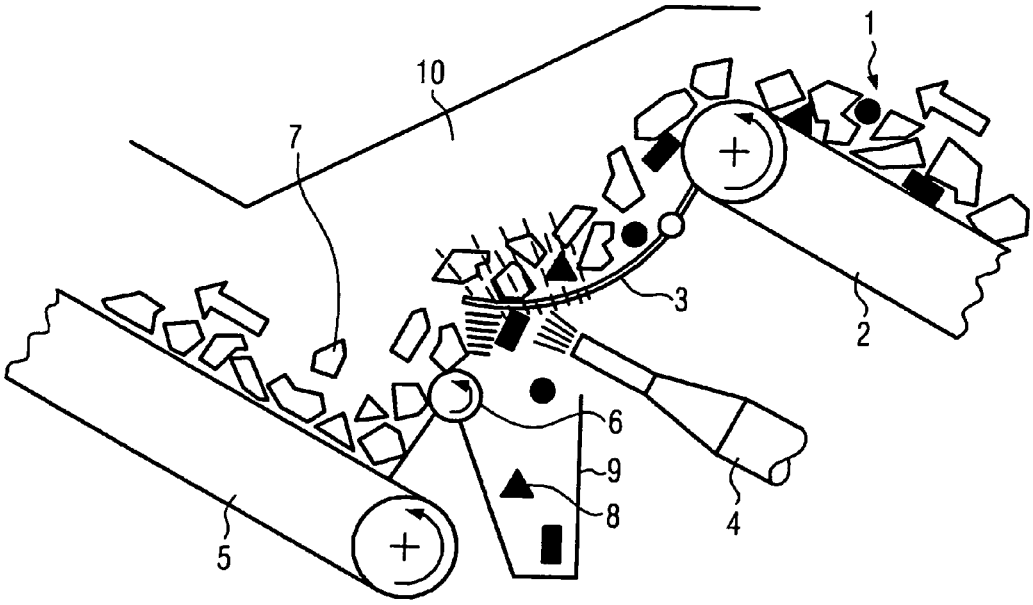
FIG. 2 is an example for a separator according to the present invention, which comprises three transport devices, one fan and one flexible means.

FIG. 2 shows an elaborated example for the separator according to the invention. As in the example illustrated with respect to FIG. 2, an inhomogeneous flow of solid material 1 with light (drawn bright) and heavy (drawn dark) material components is conveyed over the first transport device 2 to the flexible means 3. The transport device 2 is erected transversely inclined and at the upper end a flexible means 3 is connected to the transport device 2 onto which the flow of solid material is moved.

This flexible means 3 comprises a brush means with flexible bristles on the upper side. For the brush means a strip brush made of polyamide (PA 6), similar to the one as it is used for the cleaning of transport device belts is used in a simple embodiment.

A gas supply means 4 is provided underneath the flexible means 3, said gas supply means generating an air flow from underneath which partially runs through the flexible means 3. The flexible means 3 is partially lifted by the air flow. Thereby, air flows partially passing at the (material) downstream side at the flexible means 3 without reducing the velocity (in FIG. 2 the continuous lines above the air supply means designate the air starting from the air supply means and passing by the downstream side at the flexible means 3, whereas the dotted lines characterize the air passing through the flexible means).

The gas supply means can preferably supply air with an air quantity of between 7000 and 15000 cubic meters per hour, preferably between 8000 and 12000 cubic meters per hour, to achieve a satisfactory separation accuracy for a typical flow of solid material from light industrial waste or domestic waste in combination with the elastic means, which comprises a flat brush made of polyamide as it is used for cleaning transport belts. For a typical flow of solid material of light industrial waste or domestic waste it can be advantageous to control the air velocity to between 15 and 30 m/s at the entry into the flexible means.

The velocity of the air blown through the flexible means 3 reduces significantly, whereby an air cushion characterized by air swirls is generated at the surface of the flexible means 3. Lighter material components of the flow of solid material 1 moved to the flexible means 3 are lifted off by the generated air cushion from the surface of the flexible means 3 and are transported over said means. The end of the flexible means 3 is spaced apart from a second transport device 5 and a part of the air flow supplied by the gas supply means transports the light material components of the flow of solid material to an auxiliary transport device 6, which is connected to the transport device 5 and which together with the downstream end of the flexible means 3 defines the open gap through which a part of the supplied air flows to transport the light components from the flexible means 3 downwards (of the material).

In the example shown the transport device belt of the auxiliary transport device 6 is oriented perpendicular with respect to the one of the transport device 5. Different angles of the transport device belts to one another are possible. The auxiliary transport device 6 also represents an optical component of the entire system. The light material components 7 are finally conveyed downstream by the second transport device 5.

The heavy material components 8, i.e. the components of the inhomogeneous flow of solid material 1 with a high specific density are not lifted by the air cushion formed on the surface of the flexible means 3 but temporarily remain on or between the brush bristles to then reach through the openings of the intermediate bristle portion downwards into a respective reservoir 9.

The flexible means 3 does not necessarily comprise a brush means. It is essential that it passes gas supplied from below and passes heavy material components towards the bottom. A lamella means can replace the brush means. Furthermore, the bristles can be formed as non-flexible pins or rods.

An expansion chamber is provided above the flexible means 3, said chamber being characterized by reference numeral 10 in FIG. 2, and which serves the purpose of reducing the velocity of the air flow. The expansion chamber has a gas outlet which can optionally be connected to the gas supply means.

The extension of the flexible means 3 from the downstream end of the conveying means 2 in the direction of the upstream end of the transport device 5 can be selected differently. Particularly, a distance between the downstream end of the flexible means 3 and the upstream end of the transport device 5 or of the auxiliary transport device 6 can be provide according to an advantageous embodiment. The heavy material components can be separated both through the flexible means and downwards in the gap generated by said distance. The air passing by the downstream end of the flexible means 3 carries the light material components across the entire gap.

Figure 3:
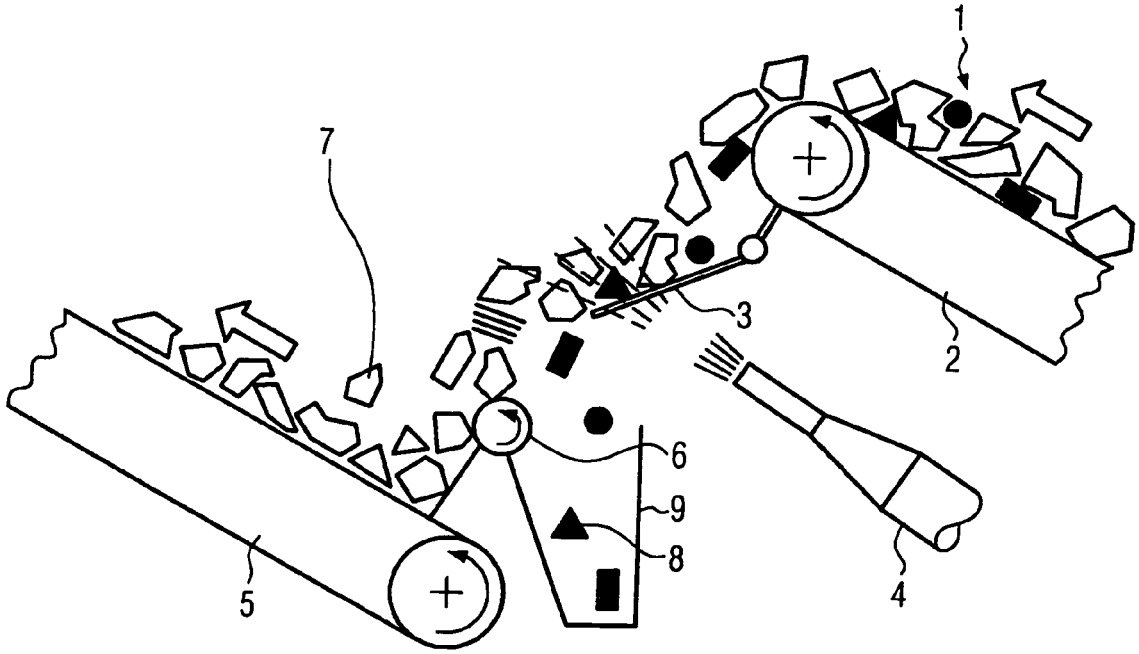
FIG. 3 is a further example for a separator according to the present invention, which comprises a metal plate provided with small holes as a flexible means.

In FIG. 3 the means 3 between the transport devices 2 and 5 or 6 is represented by a metal plate. This plate has holes through which the air supplied from below through the air supply means 4 partially passes through. Heavy material components, which are conveyed by the transport device 2 to the means 3, impinge thereon and bounce from the metal plate 3 in the downstream direction, i.e. in the direction of the gap. While the light material components 7 are carried to the transport device 6 over the gap between the transport device 6 and the downstream end of the metal plate 3 by the air partially passed by the downstream end of the metal plate 3 the heavy material components 8 fall downwards into the provided reservoir.

In this example the heavy material components are separated not at least partially through the means 3 but are separated rather exclusively downstream by the means from the material flow.

The invention claimed is:

1. Separator for separating heavy material components, particularly stones, ceramic material and glass, of an inhomogeneous flow of solid matter which comprises heavy and light material components, comprising a first conveying means for conveying the flow of solid matter;

a second conveying means provided downstream of the first conveying means for conveying non-separated material components of the flow of solid matter;

a flexible means arranged between the downstream end of the first conveying means and the upstream end of the second conveying means and which is adapted such that the light material components are transported from the first conveying means via the flexible means to the second conveying means, and the heavy material components leave the flow of solid material in front of the upstream end of the second conveying means, wherein the heavy material components bend the flexible means and overcome a restoring force of the flexible means to an extent that the heavy material components drop from a movable free end of the flexible means upstream of the second conveying means; and gas supply means for supplying gas such that the flexible means is supported against the bending caused by the weight of the light and heavy material components to an extent allowing the light material components to be transported from the first conveying means via the flexible means to the second conveying means.

2. Separator as claimed in claim 1, in which the means is at least partially pervious to gas and at least partially pervious to the heavy material components.

3. Separator as claimed in claim 1, in which the flexible means comprises a brush means with fixedly arranged or adjustable bristles.

4. Separator as claimed in claim 1, in which the flexible means comprises a lamella means with fixedly arranged or adjustable lamellae.

5. Separator as claimed in claim 1 in which the gas supply means is provided such that it supplies gas partially through the means and partially at the downstream side past the flexible means.

6. Separator as claimed in claim 1 in which the flexible means includes at least two flexible elements, the flexible elements being steel sheets or being made of plastics, at its downstream end, said elements being provided such that they convey independent of one another the light material components from the first conveying means to the second conveying means, and the heavy material components leave the flow of solid material in front of the upstream end of the second conveying means.

7. Separator as claimed in claim 1, in which the flexible means is connected to the first conveying means and/or the second conveying means.

8. Separator as claimed in claim 1, in which the flexible means is a metal plate with a plurality of openings, further comprising a gas supply means for supplying gas partially through the openings of the metal plate and partially past the downstream side of the metal plate.

9. Separator as claimed in claim 1, further comprising a third conveying means, connected upstream with the second conveying means and which accepts the light non-separated material components and conveys it to the second conveying means.

10. Separator as claimed in claim 1, in which an expansion chamber for the expansion of the gas is provided above the flexible means.

11. Separator as claimed in claim 10, further comprising a suction means for sucking off the gas from the expansion chamber and/or a gas return means for returning the gas from the expansion chamber to the gas supply means.

12. Separator as claimed in claim 1, in which the gas supply means is provided such that it supplies air in a controlled manner according to the weight of the heavy and/or light material components.

13. Method of separating heavy material components, particularly stones, ceramic material and glass from a flow of solid material, comprising conveying a flow of solid material comprising heavy and light material components to a separation position;

accepting the flow of solid material at a flexible means at the separation position;

supplying a gas to the separation position and partially through the flexible means and/or partially past a downstream side of the flexible means, in a manner that 1) the flexible means is supported, 2) a gas cushion is formed above the flexible means for carrying the light material components, and 3) light material components are transported from the downstream end of the flexible means downstream; and separating the heavy material by the flexible means, wherein the heavy material components bend the flexible means and overcome a restoring force of the flexible means and the support of the gas to an extent that the heavy material components drop from a movable free end of the flexible means downstream of the flexible means.

14. Method as claimed in claim 13, in which the gas quantity, gas velocity and gas flow direction are controlled manually or automatically according to the composition of the flow of solid material.

* * * * *